US012291956B2

(12) United States Patent
Samuel et al.

(10) Patent No.: US 12,291,956 B2
(45) Date of Patent: May 6, 2025

(54) MECHANICAL AND HYDROMECHANICAL SPECIFIC ENERGY-BASED DRILLING

(71) Applicant: Landmark Graphics Corporation, Houston, TX (US)

(72) Inventors: Robello Samuel, Cypress, TX (US); Ying Zhao, Tangshan (CN)

(73) Assignee: Landmark Graphics Corporation, Houston, TX (US)

( * ) Notice: Subject to any disclaimer, the term of this patent is extended or adjusted under 35 U.S.C. 154(b) by 497 days.

(21) Appl. No.: 17/597,831

(22) PCT Filed: Aug. 26, 2019

(86) PCT No.: PCT/CN2019/102567

§ 371 (c)(1),
(2) Date: Jan. 25, 2022

(87) PCT Pub. No.: WO2021/035472

PCT Pub. Date: Mar. 4, 2021

(65) Prior Publication Data

US 2022/0259968 A1 Aug. 18, 2022

(51) Int. Cl.
*E21B 44/04* (2006.01)
*E21B 7/04* (2006.01)
(Continued)

(52) U.S. Cl.
CPC ..... *E21B 44/04* (2013.01); *E21B 7/04* (2013.01); *E21B 45/00* (2013.01); *E21B 44/00* (2013.01); *E21B 2200/20* (2020.05)

(58) Field of Classification Search
CPC . E21B 44/04; E21B 7/04; E21B 45/00; E21B 44/00; E21B 2200/20
See application file for complete search history.

(56) References Cited

U.S. PATENT DOCUMENTS 8,833,487 B2 9/2014 Krueger, IV et al.
10,221,671 B1 * 3/2019 Zhang ..... G06N 3/084
(Continued)

FOREIGN PATENT DOCUMENTS

CN 101600852 A 12/2009
CN 104145079 A 11/2014
(Continued)

OTHER PUBLICATIONS

Johancsik, et al., "Torque and Drag in Directional Wells—Prediction and Measurement", Journal of Petroleum Technology, 36 (6): 987-992, DOI: 10.2118/11380-PA, Jun. 1984, 6 pages.
Mohan, et al., "Comprehensive Hydromechanical Specific Energy Calculation for Drilling Efficiency", Journal of Energy Resources Technology, vol. 137, Jan. 2015, 8 pages.
(Continued)

*Primary Examiner* — Ricky Go
(74) *Attorney, Agent, or Firm* — DeLizio, Peacock, Lewin & Guerra LLP

(57) ABSTRACT

A method comprises drilling a borehole and capturing data during drilling of the borehole, wherein the data comprises at least one value of at least one operational parameter of the drilling. A specific energy formula is modified and used to determine at least one of an efficiency and a quality of drilling of a borehole. Modifying the specific energy formula is based on data captured during drilling of the borehole. The specific energy formula comprises at least one of a mechanical specific energy formula and a hydromechanical specific energy formula. An adjusted specific energy value for the drilling is calculated based on the modified specific energy formula. At least one of the efficiency and the quality of the drilling of the borehole is determined based on the adjusted specific energy value. Also disclosed is a system comprising a machine-readable medium having program code executing the method.

18 Claims, 6 Drawing Sheets

(51) Int. Cl.
*E21B 45/00* (2006.01)
*E21B 44/00* (2006.01)

(56) References Cited

U.S. PATENT DOCUMENTS

| | | | | |
|---|---|---|---|---|
| 2013/0105221 | A1* | 5/2013 | Wassell | E21B 44/04 175/40 |
| 2013/0146358 | A1* | 6/2013 | DiSantis | E21B 44/02 175/27 |
| 2014/0326449 | A1* | 11/2014 | Samuel | E21B 41/00 340/853.3 |
| 2015/0090498 | A1 | 4/2015 | Hareland | |
| 2016/0054729 | A1* | 2/2016 | Payette | E21B 44/04 700/275 |
| 2017/0306703 | A1* | 10/2017 | Samuel | E21B 44/00 |

FOREIGN PATENT DOCUMENTS

| | | | |
|---|---|---|---|
| CN | 104246107 | A | 12/2014 |
| WO | 2010114784 | A2 | 10/2010 |

OTHER PUBLICATIONS

PCT Application Serial No. PCT/CN2019/102567, Written Opinion, mailed May 28, 2020, 4 pages.

PCT Application Serial No. PCT/CN2019/102567, International Search Report, mailed May 28, 2020, 5 pages.

Mohan, et al., "Tracking Drilling Efficiency Using Hydro-Mechanical Specific Energy", SPE/IADC Drilling Conference and Exhibition, Mar. 17-19, 2009 (SPE-119421-MS), 13 pages.

Teale, "The Concept of Specific Energy in Rock Drilling", International Journal of Rock Mechanics and Mining Sciences & Geomechanics Abstracts, vol. 2, Issue 1, Mar. 1965, pp. 57-73.

* cited by examiner

MECHANICAL AND HYDROMECHANICAL SPECIFIC ENERGY-BASED DRILLING

TECHNICAL FIELD

The disclosure generally relates to the field of wellbore drilling, and more particularly to modifying drilling based on mechanical and hydromechanical specific energies.

BACKGROUND

During drilling or planning phases of drilling operations, mechanical specific energy (MSE) is often used to provide an indicator of drilling efficiency. MSE is a measurement of the energy exerted to remove a unit volume of rock. MSE depends on weight on bit, torque, rate of penetration, and drill bit revolutions per minute. To account for exertion of hydraulic energy, hydromechanical drilling specific energy (HMSE) can also be used to provide a measure of drilling efficiency. HMSE depends on the parameters which influence MSE in addition to hydraulic parameters, such as flow rate, pressure drop across the drill bit, and drilling fluid weight. MSE and HMSE values have an inverse relationship with drilling efficiency. For example, a high MSE value indicates that the drilling operation may be inefficient.

BRIEF DESCRIPTION OF THE DRAWINGS

Embodiments of the disclosure may be better understood by referencing the accompanying drawings.

DESCRIPTION OF EMBODIMENTS

Figure 1:
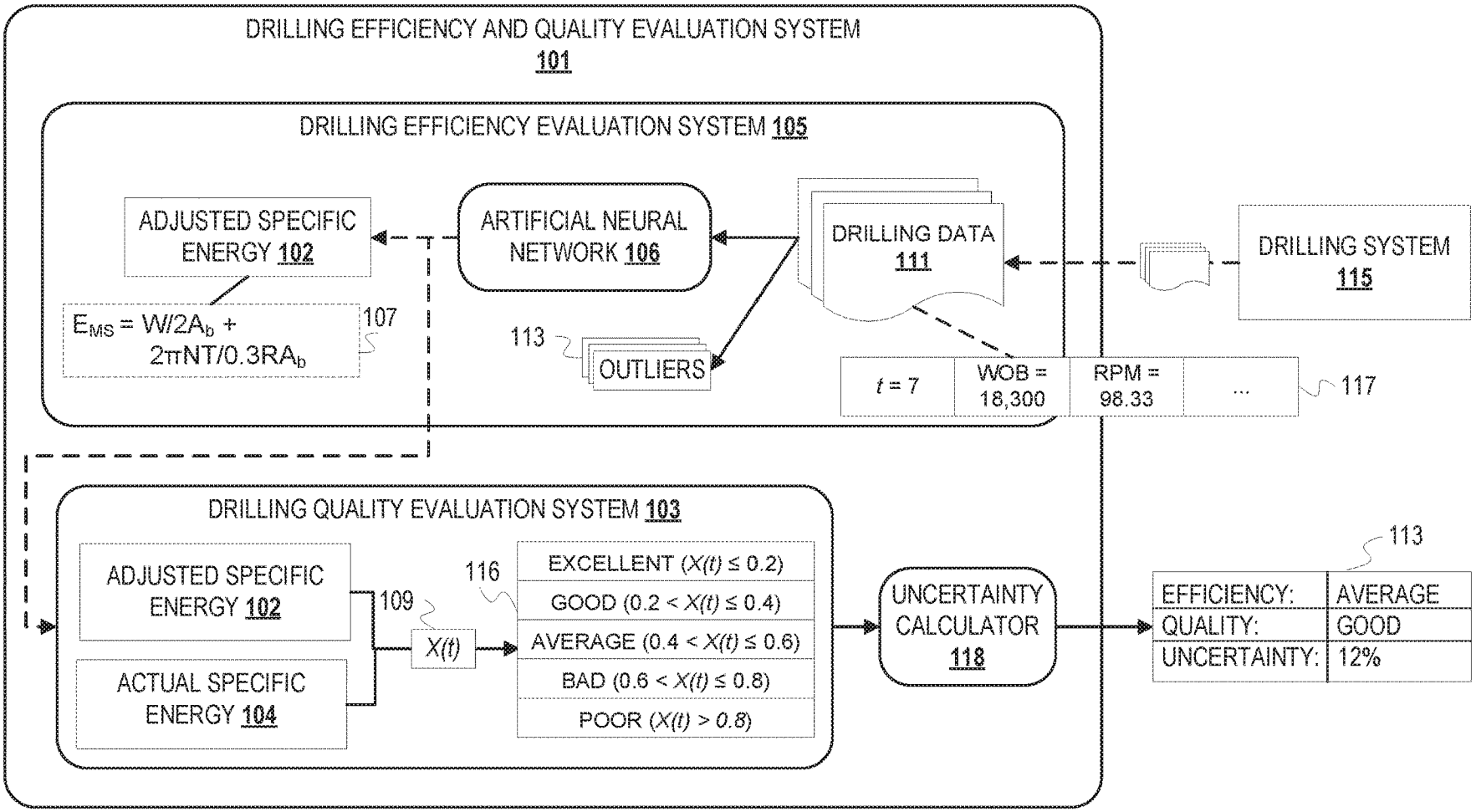
FIG. 1 depicts an example conceptual diagram of evaluating drilling efficiency and drilling quality based on adjusted mechanical or hydromechanical specific energies, according to some embodiments.

The description that follows includes example systems, methods, techniques, and program flows that embody aspects of the disclosure. However, it is understood that this disclosure may be practiced without these specific details. or instance, this disclosure refers to using dimensionality reduction of data captured during a drilling operation in illustrative examples. Aspects of this disclosure can be also applied to other applications for analysis of data captured during a drilling operation. Additionally, some of the operations are described as being perform by an artificial neural network (ANN). However, in some embodiments, such operations can be performed independent of an ANN. In other instances, well-known instruction instances, protocols, structures and techniques have not been shown in detail in order not to obfuscate the description.

The efficiency of a drilling operation may be affected by conditions that are not accounted for by operational parameters used to determine MSE/HMSE, which can be example indicators of drilling efficiency. Rotating on bottom, slide, and backreaming may vary between drilling operations. Additionally, friction force influences drilling operations. For instance, static friction, kinetic friction, sliding/rolling friction, and angle of friction can influence torque and drag calculations as well as hydraulics calculations, including surge, swab, and hook load estimation during cementing. Simulation of drilling operations with friction force introduces uncertainties, such as drilling fluid type and lubricity, pack off, cuttings bed qualities, doglegs, key seating, wellbore torsion or tortuosity, wellbore diameter, viscosity, asperity, and/or drill string stiffness. Variations between drilling operations, friction force, and the uncertainties resulting from consideration of friction force are not accounted for in the equations traditionally used for calculating MSE and HMSE.

According to some embodiments, to improve evaluation of drilling efficiency, MSE/HMSE formulas are modified to account for variable contributions of the operational parameters to the specific energy as a result of the variations and uncertainties in a drilling operation. For example, the MSE/HMSE formula can be modified based on "hidden" relationships between drilling data and the observed MSE/HMSE to provide an accurate indicator of the efficiency of a drilling operation. MSE/HMSE formulas can be modified by weighting the parameters in the conventional MSE/HMSE formulas, such as by introducing coefficients or exponents. Unsupervised machine learning techniques can be leveraged for analysis of drilling data obtained from a drilling operation to determine the modified MSE/HMSE formulas. In some embodiments, outliers in the drilling data, such as outliers due to anomalous behavior (e.g., sensor failures), can be removed to prevent these outliers from influencing the modified MSE/HMSE formula determination. The weights assigned to the parameters can be based on relationships between the parameters and other drilling data to determine the impact of each parameter on the specific energy. The resulting "predicted" MSE/HMSE, or the adjusted MSE/HMSE, can be utilized to more accurately determine drilling efficiency and adjust parameters of the drilling operation accordingly.

In addition to improving evaluation of drilling efficiency, the adjusted MSE/HMSE can be used to determine the quality of a drilling operation. A drilling operation may be efficient but producing a borehole of poor quality; conversely, a drilling operation may be inefficient but producing a borehole of high quality. A drilling efficiency indicator and drilling quality indicator determined based on the adjusted MSE/HMSE can provide a basis for comparing efficiency and quality of drilling operations to quickly determine whether either efficiency or quality has changed. As a result, operational parameters and other drilling parameters can be adjusted during the subsequent drilling operations based on the determined changes in quality or efficiency. Using the modified MSE/HMSE formula during subsequent drilling operations can reduce nonproductive time and invisible lost time.

Example Illustrations

FIG. 1 depicts an example conceptual diagram of evaluating drilling efficiency and drilling quality based on adjusted mechanical or hydromechanical specific energies, according to some embodiments. FIG. 1 depicts a drilling efficiency and quality evaluation system 101 which includes a drilling efficiency evaluation system ("efficiency evaluation system") 105 and a drilling quality evaluation system ("quality evaluation system") 103. The efficiency evaluation system 105 analyzes drilling data 111 to determine a modified specific energy formula 107. In this example, the efficiency evaluation system 105 uses unsupervised learning techniques to determine the modified specific energy formula 107. The modified specific energy formula 107 can be a formula for the MSE or HMSE with additional weights on the parameters, where weights may be coefficients and/or exponents. An adjusted specific energy 102 is the MSE or HMSE predicted by the modified specific energy formula 107, whereas an actual specific energy 104 is calculated with the original, unmodified MSE or HMSE formulas.

Figure 5:
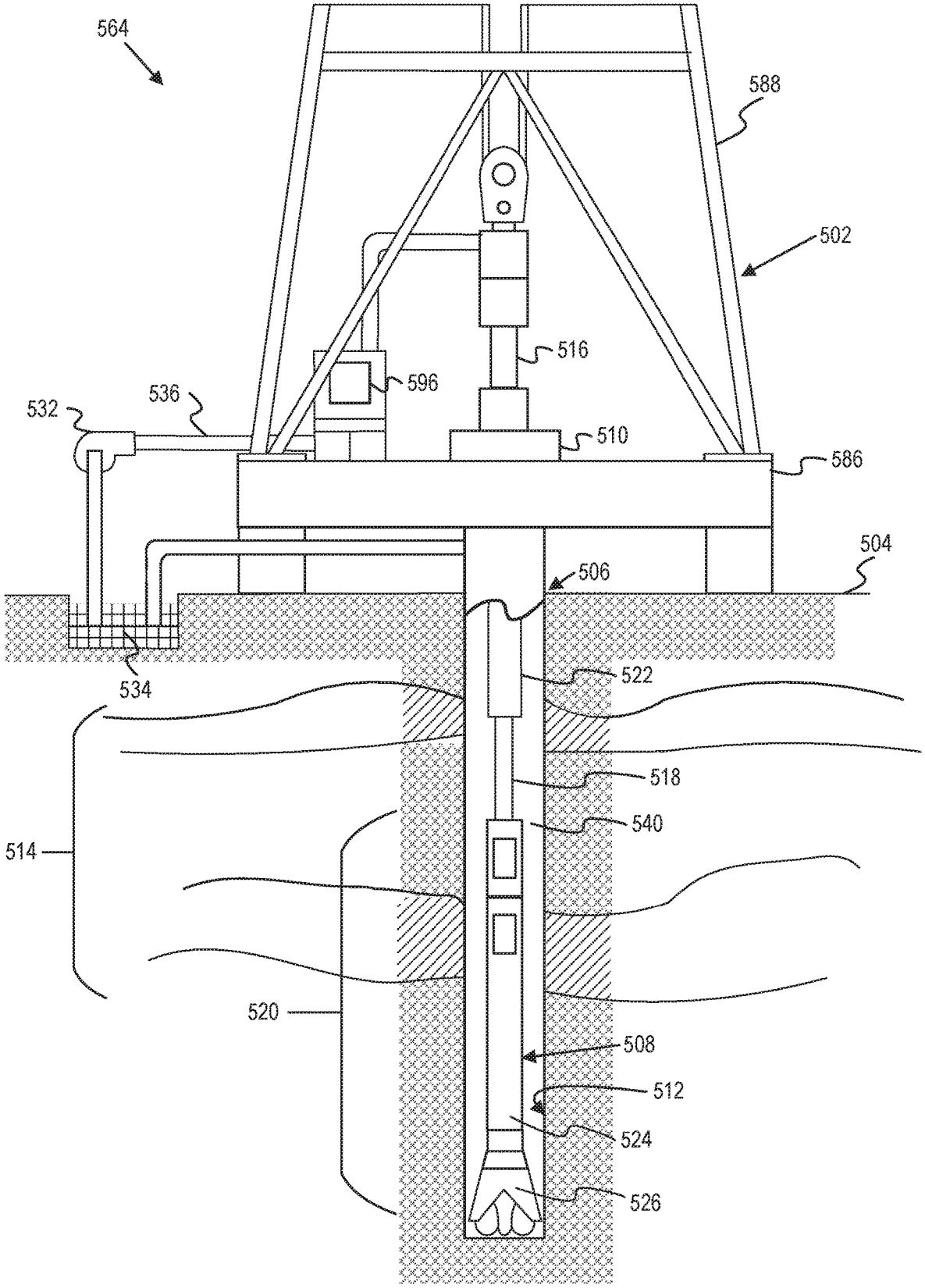
FIG. 5 depicts a schematic diagram of a drilling rig system, according to some embodiments.

The drilling data 111 can be captured by various components of a drilling system 115 during a drilling operation. For example, the drilling data 111 can be captured by sensors that are part of a bottom hole assembly of a drill string. An example of such a configuration is depicted in FIG. 5, which is further described below. The drilling data 111 can be retrieved from the components of the drilling system 115 by the efficiency evaluation system 105 or can be communicated to the efficiency evaluation system 105 from the components of the drilling system 115. The drilling data 111 may be represented as a collection of feature vectors containing measured and/or calculated values of parameters of a drilling operation over a series of time steps, where each feature included in the drilling data 111 can be the measured and/or calculated values of drilling data corresponding to a particular time step. For instance, the drilling data 111 can include data collected for operational parameters, design parameters, and/or calculated parameters. Data collected for operational parameters can include weight on bit, rate of penetration, flow rate, and drill bit revolutions per minute (RPM) data. Data collected for design parameters can include drill bit diameter, reamer diameter, reamer area, drill bit nozzle area, and drilling fluid weight data. The calculated parameters can include effective weight on bit, drill bit pressure drop, torque, side torque, and side force, where the calculated parameters can be calculated based on the data collected for the operational and design parameters. The drilling efficiency and quality evaluation system 101 may calculate the calculated parameters based on receiving the drilling data 111. Alternatively, components of the drilling system 115 may calculate the calculated parameters before communicating the drilling data 111 to the drilling efficiency and quality evaluation system 101. As depicted in FIG. 1, a feature vector 117 of the set of drilling data 111 includes values for various parameters including weight on bit and drill bit RPM. For example, values of the weight on bit and drill bit RPM collected at time t=7 may be 18,300 kilograms and 98.33 RPM, respectively.

An artificial neural network ("ANN") 106 of the efficiency evaluation system 105 can detect and remove outliers 113 while processing examples of the drilling data 111. The outliers 113 can be individual data points of an example of the drilling data 111 (e.g., values corresponding to individual features within a feature vector) which are discarded from consideration. For instance, an outlier may be a drill bit RPM value in a feature vector such as the feature vector 117 which is identified as an outlier. Outliers can result from anomalous behavior of the drilling system 115 equipment, such as sensor failures. Outliers can also result from abnormal downhole conditions. Considering outliers when determining the modified specific energy formula 107 can result in calculating an adjusted specific energy 102 which is influenced by anomalies and is thus an inaccurate indicator of drilling efficiency. To reduce errors or inaccuracies which may impact calculation of the adjusted specific energy 102, the efficiency evaluation system 105 can detect the outliers 113 with the ANN 106 and discount the detected outliers 113 from the determination of the weights used in the modified specific energy formula 107. The outliers 113 may be determined by enforcing thresholds in the ANN 106 for minimum and/or maximum values for features in the drilling data 111 (e.g., by including a hidden layer which enforces thresholds). For instance, thresholds can be established which indicate minimum and maximum values for weight on bit, flow rate, RPM, etc. As an example, for drill bit RPM values, minimum and maximum thresholds of 0 RPM and 10,000 RPM may be established. The ANN 106 can then recognize negative RPM values and RPM values over 10,000 as outliers. The thresholds may be established based on values that can be identified as potentially corresponding to anomalous behavior, such as sensor failures or errors in sensor readings. For instance, negative values may be identified as outliers in instances where a negative value would not be expected from a normal sensor reading. Additionally, values which indicate a maximum possible sensor reading may be indicative of a sensor failure and can thus be identified as outliers (e.g., a drill bit RPM value of 99,999).

The ANN 106 of the efficiency evaluation system 105 can also leverage machine learning techniques to determine weights to be assigned to parameters of the MSE or HMSE formula based on the drilling data 111 to result in the modified specific energy formula 107, where the modified specific energy formula 107 is the MSE or HMSE formula with the weights determined for the parameters. By using the ANN 106 with the drilling data 111 as input, MSE and HMSE formulas can be modified by assigning coefficients and/or exponents to parameters of the specific energy formulas based on the output of the ANN 106. Typically, the MSE $E_{MS}$ can be calculated as shown in Equation 1, where W is weight on bit, $A_b$ is area of the drill bit, Nis rotations per minute, T is torque, and R is rate of penetration.

$$E_{MS} = \frac{W}{A_b} + \frac{2\pi NT}{A_b R} \tag{1}$$

When utilizing hydraulic energy for a drilling operation, the HMSE $E_{HS}$ can be calculated as shown in Equation 2, where W is weight on bit, $W_{eff}$ is effective weight on bit, $A_b$ is area of the drill bit, N is drill bit RPM, Tis torque, R is rate of penetration, Q is flow rate, $\Delta P_b$ is drill bit pressure change, and $\rho_m$ is drilling fluid weight. Formulas for the effective weight on bit $W_{eff}$ and the drill bit pressure change $\Delta P_b$ are given in Equation 3 and Equation 4, respectively, where $C_d$ is the drill bit nozzle discharge coefficient and $A_n$ is drill bit nozzle area.

$$E_{HS} = \frac{W_{eff}}{A_b} + \frac{120\pi NT}{A_b R} + \frac{Q\Delta P_b}{A_b R} \tag{2}$$

$$W_{eff} = W - \frac{Q}{58}\sqrt{\rho_m \Delta P_b} \tag{3}$$

$$\Delta P_b = \frac{8.311 \times 10^{-5} \rho_m Q^2}{C_d^2 A_n^2} \tag{4}$$

In some cases, additional torque may be experienced at the side of the drill bit while drilling a borehole. A side torque can be experienced if the borehole is drilled with a curve which deviates from the vertical portion of the borehole (e.g., during horizontal drilling). The HMSE formula for the HMSE exerted during drilling in which the drill bit experiences side torque can be represented as follows in Equation 5, where $F_s$ is force on the side of the drill bit and μ is the coefficient of friction.

$$E_{HS} = \frac{W_{eff}}{A_b} + \frac{40\pi\mu N(4F_s + W_{eff})}{A_b R} + \frac{Q\Delta P_b}{A_b R} \tag{5}$$

The MSE and HMSE formulas depicted as Equations 1, 2, and 5 can be modified with coefficients and/or exponents based on the output of the ANN 106. An example modified MSE formula and an example modified HMSE formula are given as Equation 6 and Equation 7, respectively, where $c_1$-$c_4$ represent weights which can be assigned to the parameters.

$$E_{MS} = \frac{c_1 W}{A_b} + \frac{2\pi NT}{c_2 R A_b} \tag{6}$$

$$E_{HS} = \frac{W_{eff}}{A_b} + \frac{120\pi NT}{A_b R} + \frac{c_3 Q \times \Delta P_b}{A_b R^{c4}} \tag{7}$$

The efficiency evaluation system 105 can determine if a modified MSE or a modified HMSE should be generated based on whether hydraulic energy is exerted in the current drilling operation. For instance, the efficiency evaluation system 105 can identify whether hydraulic parameters are included as features in the drilling data 111, may receive an indication that hydraulic energy is to be included to generate a modified HMSE formula, etc. To determine a modified MSE or HMSE formula, such as similar to those given in Equations 6 and 7, the ANN 106 can use unsupervised learning techniques to determine how the various features of the drilling data 111 influence the MSE or HMSE exerted for a drilling operation. The efficiency evaluation system 105 may normalize the drilling data 111 before using the ANN 106 with the drilling data 111 as its input. For instance, the efficiency evaluation system 105 may convert data collected for each drilling parameter included in the drilling data to a normalized value ranging from 0 to 1.

The ANN 106 can determine weights to be assigned to parameters of a specific energy formula to generate the modified specific energy formula 107 based on reduction of dimensionality of the drilling data 111. With dimensionality reduction, the ANN 106 can determine the impact of each of the drilling parameters (i.e., operational, design, and/or calculated parameters) on the MSE or HMSE during a drilling operation. The ANN 106 can remove the features which have minimal or no impact or may increase the weight of those which have a high impact. The ANN 106 may leverage feature selection to reduce the dimensions of the drilling data 111 based on which parameters have a lower "contribution" to the MSE or HMSE. For instance, the ANN 106 may discover that there is no correlation between the weight on bit and the rest of the features (e.g., RPM, torque, etc.). The ANN 106 may thus determine that weight on bit is a "weak" feature which does not significantly impact the MSE/HMSE of a drilling operation. Based on determining that the weight on bit is not correlated with the rest of the features, the ANN 106 may decrease the weight to be assigned to the weight on bit in the modified MSE/HMSE formula. As another example, the ANN 106 may determine that torque is highly correlated with flow rate and torque. The ANN 106 can then determine that torque is a "strong" parameter which impacts the MSE/HMSE of a drilling operation and will thus increase its weight in the modified MSE/HMSE equation. To reduce the dimensionality of the drilling data 111, the ANN 106 may, for instance, perform feature selection for the drilling data 111 or a subset of the drilling data 111 by using sequential backward selection, random forests, etc. Alternatively, the ANN 106 can use feature extraction to determine a reduced-dimensional representation of the feature vectors of the drilling data 111. Weights assigned to the parameters can be adjusted based on the results of dimensionality reduction. For instance, the ANN 106 may decrease the weight assigned to the weight on bit parameter if the weight on bit consistently shows no correlation with other drilling parameters. The ANN 106 may increase the weight of the torque based on identifying a high correlation between torque and other drilling parameters of the drilling operation.

In the example depicted in FIG. 1, the modified specific energy formula 107 resulting from running the ANN 106 with the drilling data 111 as input is given as $E_{MS}=W/2A_b+2\pi NT/0.3RA_b$, where a coefficient of 2 has been assigned to the drill bit area parameter and a coefficient of 0.3 has been assigned to the rate of penetration parameter. The adjusted specific energy 102 can be calculated based on the modified specific energy formula 107. The efficiency evaluation system 105 communicates the adjusted specific energy 102 to the quality evaluation system 103. The efficiency evaluation system 105 may also determine an efficiency indicator for the drilling operation based on the adjusted specific energy 102. For instance, the efficiency evaluation system 105 may enforce one or more thresholds for adjusted specific energy values to classify the drilling operation as "efficient," "highly efficient," "average efficiency," etc. As an example, the efficiency evaluation system 105 may enforce thresholds for the adjusted MSE/HMSE of 30 kilojoules (kJ) for "highly efficient," 50 kJ for "average efficiency," etc.

The quality evaluation system 103 receives the adjusted specific energy 102 from the efficiency evaluation system 105 and calculates the actual specific energy 104. The actual specific energy 104 is the MSE or HMSE as calculated using the original, unmodified formulas and can be calculated with one of the MSE or HMSE formulas depicted above as Equations 1, 2, and 5. The quality evaluation system 103 can calculate the adjusted specific energy 102 and the actual specific energy 104 based on values corresponding to one feature vector of drilling data 111 (e.g., a feature vector of the drilling data 111 corresponding to a particular time t), an average of values corresponding to feature vectors in the drilling data 111 for a certain window of time (e.g., the last five time steps), etc. The quality evaluation system 103 calculates the MSE if the adjusted specific energy 102 corresponds to an MSE value. Otherwise, the quality evaluation system 103 calculates the HMSE if the adjusted specific energy 102 corresponds to an HMSE value. The efficiency evaluation system 105 may indicate whether the adjusted specific energy 102 corresponds to an MSE or an HMSE to the quality evaluation system 103 based on whether the efficiency evaluation system 105 generated a modified MSE formula or a modified HMSE formula. In this example, the modified specific energy formula 107 is a modified MSE formula, so the quality evaluation system 103 calculates the MSE for the actual specific energy 104.

The quality evaluation system 103 evaluates the adjusted specific energy 102 and the actual specific energy 104 to determine a drilling quality indicator value ("quality indicator value") 109, depicted in FIG. 1 as X(t). The quality indicator value 109 may be a ratio of the actual specific energy 104 and the adjusted specific energy 102 or a difference between the actual specific energy 104 and the adjusted specific energy 102. As another example, the quality indicator value 109 may be an absolute or relative error of the adjusted specific energy 102 with respect to the actual specific energy 104. The quality evaluation system 103 may normalize the quality indicator value 109. For example, the quality evaluation system may convert the quality indicator value to a normalized value ranging from 0 to 1, 0 to 5, etc.

The quality evaluation system 103 maintains drilling quality indicator rules ("rules") 116. The rules 116 indicate rules for classifying drilling quality based on the quality indicator value 109. For instance, drilling quality indicator rules can be a number of ranges within which the quality indicator value 109 can fall (e.g., based on the normalization of the quality indicator value 109). In this example, the rules 116 indicate five drilling quality indicators associated with a corresponding range of quality indicator values. The quality evaluation system 103 qualifies a drilling operation as "excellent quality," "good quality," "average quality," "bad quality," or "poor quality" based on determining the range indicated by the rules 116 in which the quality indicator value 109 falls. In this example, the quality evaluation system 103 determines that the normalized quality indicator value 109 is between 0.2 and 0.4, which corresponds to the drilling quality indicator of "good quality." Though FIG. 1 depicts the rules 116 as comprising five quality indicators which are determined based on ranges to which the quality indicator value 109 may correspond, the quality evaluation system 103 can implement any rule or set of rules for evaluating the quality indicator value 109. For instance, the rules 116 may include any number of quality indicators and may use any method for classifying the drilling quality.

An uncertainty calculator 118 computes an uncertainty value of the drilling efficiency and quality analysis performed by the efficiency evaluation system 105 and the quality evaluation system 103. The uncertainty value produced by the uncertainty calculator 118 indicates the uncertainty of the drilling and quality evaluation based on uncertainties of the distributions of the drilling data 111. The uncertainty value may indicate a lower uncertainty based on determining that the data collected for parameters within the drilling data 111 are uniformly distributed. For instance, if the data for drill bit RPM and weight on bit in the drilling data 111 are uniformly distributed, the uncertainty value may be a lower percentage due to the uniformity of the values collected for weight on bit and RPM. In some implementations, the uncertainty calculator 118 determines the uncertainty value by generating an uncertainty model through a Monte Carlo simulation. For example, the uncertainty calculator 118 can perform a Monte Carlo simulation with 10,000 iterations, the results of which may be averaged. In this example, the uncertainty calculator 118 computes an uncertainty value of 12%.

The drilling efficiency and quality evaluation system 101 can generate a report 112 as a result of evaluating the efficiency and quality of a drilling operation. The report 112 indicates an efficiency indicator, a quality indicator, and the uncertainty value. The report 112 can also indicate a value of the adjusted specific energy 102, actual specific energy 104, and/or the quality indicator value 109. In this example, the efficiency evaluation system 105 determined that the adjusted specific energy 102 indicates the drilling operation is of average efficiency, and the quality evaluation system 103 determined that the quality indicator value 109 indicates that the drilling operation is of good quality. The report 112 can be evaluated to determine whether parameters of the drilling operation should be adjusted to improve drilling efficiency and/or drilling quality during subsequent drilling. For instance, if a drilling operation is determined to be of low efficiency but high quality, the drilling parameters can be adjusted for continuing the drilling operation to improve the efficiency of the operation while maintaining the drilling quality. As another example, if the drilling operation is determined to be of high efficiency and high quality, the current drilling parameters can be maintained.

Figure 2:
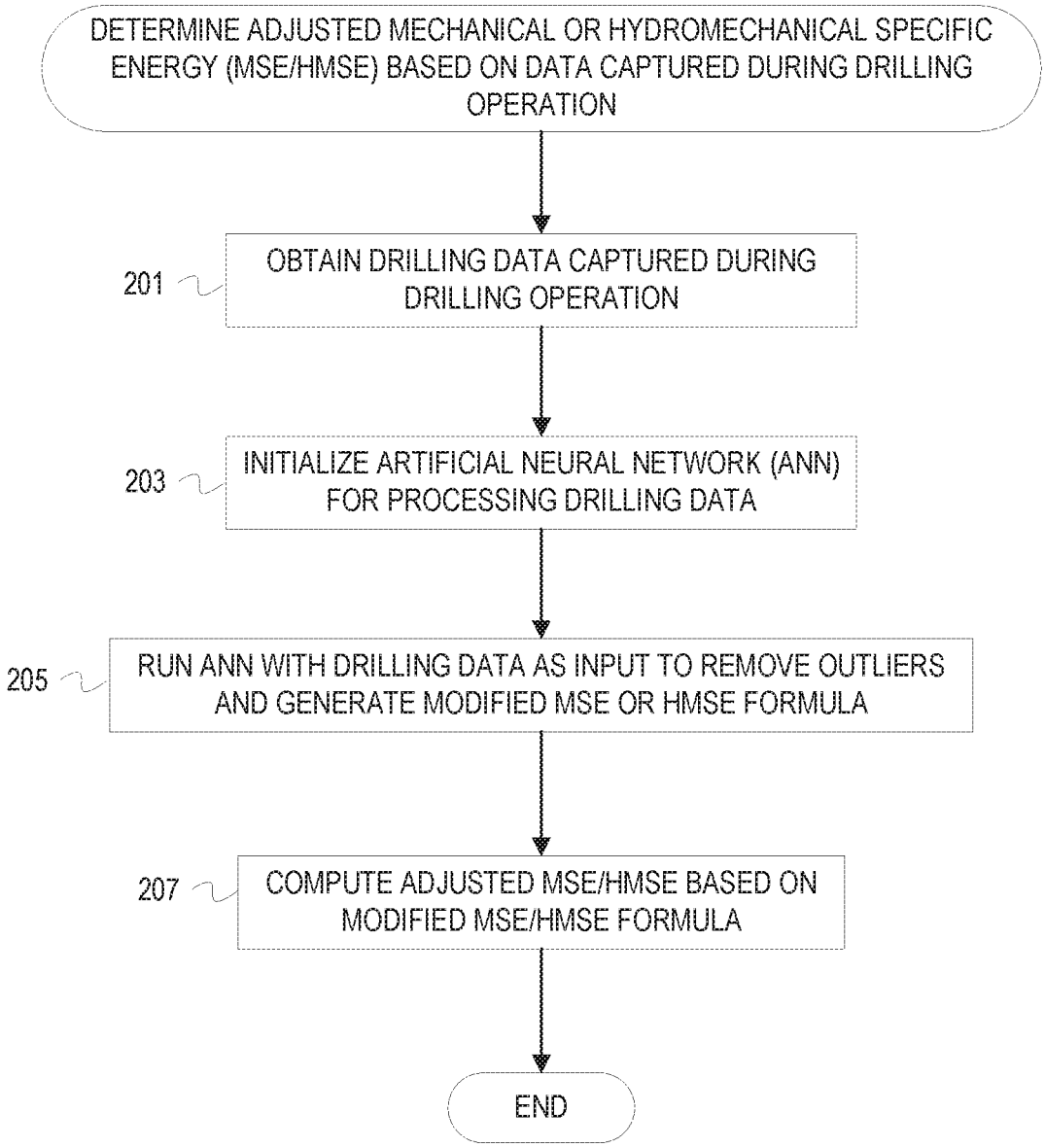
FIG. 2 depicts a flowchart of example operations for determining an adjusted mechanical or hydromechanical specific energy by modifying the mechanical or hydromechanical specific energy formula based on data captured during a drilling operation, according to some embodiments.

FIG. 2 depicts a flowchart of example operations for determining an adjusted MSE/HMSE by modifying the MSE/HMSE formula based on data collected during a drilling operation, according to some embodiments. The example operations refer to a drilling efficiency evaluation system ("efficiency evaluation system") as performing the depicted operations for consistency with FIG. 1, although naming of software and program code can vary among implementations. Additionally, the operations of FIG. 2 can be performed by any combination of software, hardware, firmware, or a combination thereof. Additionally, the operations can be performed downhole, at the surface or both downhole and at the surface.

At block 201, the efficiency evaluation system obtains drilling data collected during a drilling operation. The drilling data are measured and calculated data for various drilling parameters during a drilling operation. Drilling data which is collected may include operational parameters, design parameters, and calculated values based on the operational and/or design parameters. For instance, the drilling data can include weight on bit data, drill bit RPM data, torque data, drilling fluid weight data, etc. The efficiency evaluation system may obtain the data from various components of a drilling system (e.g., sensors) by retrieving the data from the components and/or by receiving the drilling data which is communicated to the efficiency evaluation system by the components. Sensors at different locations downhole can capture the drilling data. For example, the sensor can be in a bottom hole assembly of the drill string, at or near the drill bit, etc. The drilling data may be organized by time stamps associated with the values of the drilling data. For instance, the drilling data may include the values of the weight on bit, drill bit RPM, torque, etc. which are measured or calculated every ten seconds, every minute, etc.

At block 203, the efficiency evaluation system initializes an ANN for processing data collected during a drilling operation. The ANN can be instantiated by reading the neural network configuration (e.g., the layers, neurons, and neuron coefficients) from a previous drilling operation or by configuring layers and neurons in a new neural network. The efficiency evaluation system can also generate feature vectors from the drilling data for use by the ANN. The efficiency evaluation system may normalize the values of the drilling data when generating the feature vectors.

At block 205, the efficiency evaluation system runs the ANN with the drilling data as input to remove outliers and generate a modified MSE or HMSE formula. The ANN can detect and remove outliers in the drilling data, such as outliers due to anomalous behavior (e.g., sensor failures). Outliers are removed to prevent anomalies such as values measured by a faulty sensor from influencing the determination of the modified MSE or HMSE formula and adjusted MSE or HMSE. The ANN of the efficiency evaluation system can enforce thresholds for outlier detection for each of the features in the drilling data based on values known to correspond to anomalies or irregular patterns. For instance, a threshold can be set which indicates that negative drill bit RPM values are to be detected as outliers and discarded. As another example, a threshold can be set which indicates that flow rate values greater than 10,000 cubic meters per second are to be detected as outliers and discarded. The ANN of the efficiency evaluation system can determine the impact of the features in the drilling data on the specific energy of a drilling operation to assign weights (e.g., coefficients and/or exponents) to the parameters for modification of the MSE/HMSE formula, such as through dimensionality reduction. Parameters for which a high number of anomalies were detected and/or which showed low correlation with other parameters based on the drilling data can be assigned a lower weight. Similarly, parameters for which a low number of anomalies were detected and/or which showed high correlation with other parameters based on the drilling data can be assigned a higher weight.

At block 207, the efficiency evaluation system computes an adjusted MSE or HMSE based on the modified MSE or HMSE formula. The adjusted MSE or HMSE value indicates the energy exerted during a drilling operation which is based on the data retrieved from the drilling operation itself. The adjusted MSE or HMSE can be used to determine the efficiency of the drilling operation. For instance, the efficiency evaluation system may enforce one or more thresholds for determining the drilling efficiency, where the drilling efficiency can be qualified based on the adjusted MSE or HMSE exceeding a threshold. As an example, the efficiency evaluation system may enforce thresholds for the adjusted MSE or HMSE which quality the drilling efficiency as "efficient," "inefficient," or "highly efficient." The efficiency of the drilling operation can be qualified based on the value of the adjusted MSE or HMSE in comparison with these efficiency thresholds.

Figure 3:
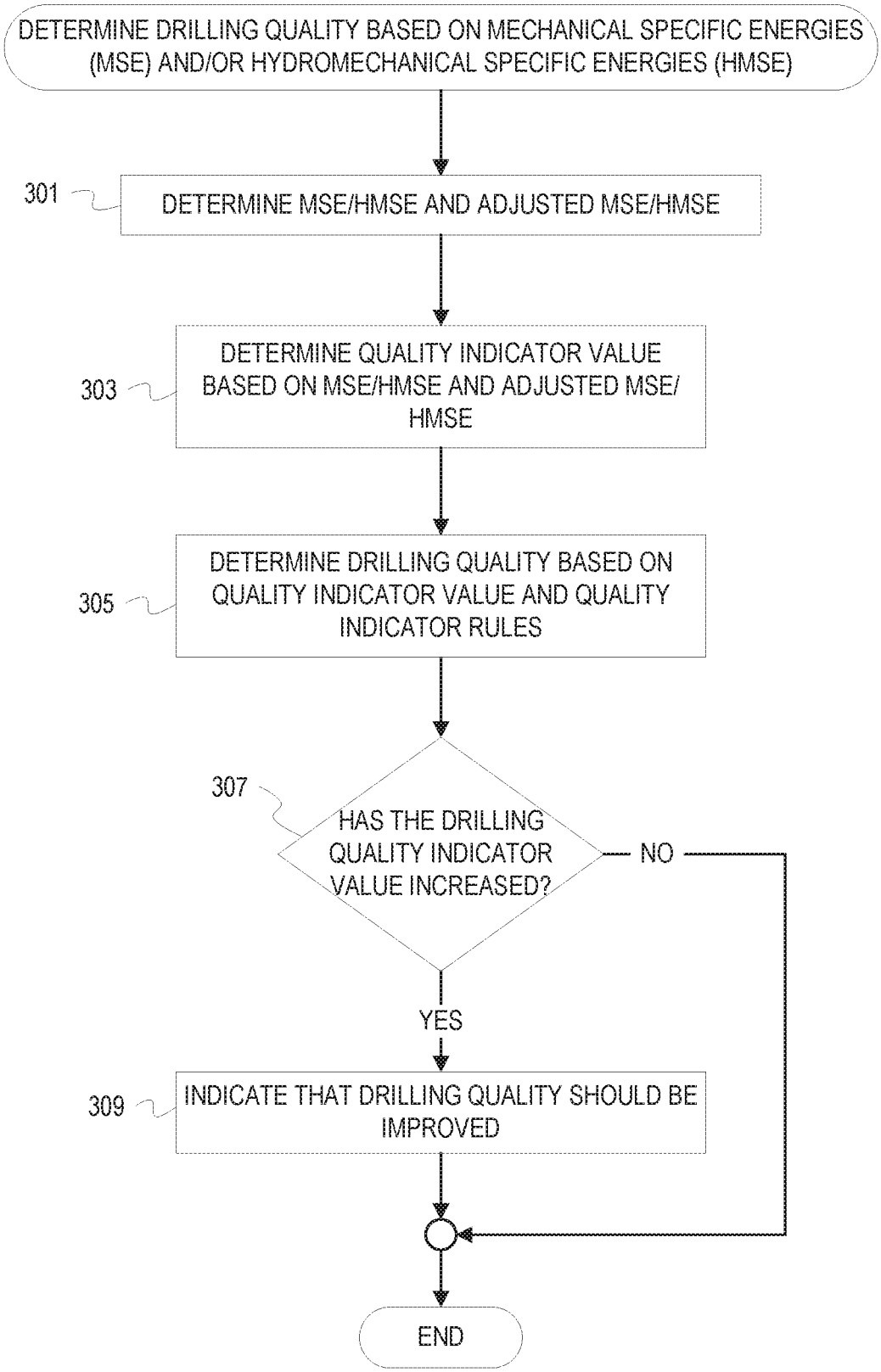
FIG. 3 depicts a flowchart of example operations for determining quality of a drilling operation based on the mechanical or hydromechanical specific energy and the adjusted mechanical or hydromechanical specific energy, according to some embodiments.

FIG. 3 depicts a flowchart of example operations for determining quality of a drilling operation based on the MSE/HMSE and the adjusted MSE/HMSE, according to some embodiments. The example operations refer to a drilling efficiency and quality evaluation system ("evaluation system") as performing the depicted operations for consistency with FIG. 1, although naming of software and program code can vary among implementations. The example operations can occur periodically during drilling to evaluate drilling quality, such as periodically during a single drilling operation, between drilling operations, etc.

At block 301, the evaluation system determines the MSE/HMSE and the adjusted MSE/HMSE. The evaluation system determines the MSE/HMSE and the adjusted MSE/HMSE as described in reference to FIGS. 1 and 2. For instance, the evaluation system can use an ANN which leverages unsupervised learning techniques to analyze data collected during a drilling operation to determine weights to assign to parameters of the MSE or HMSE formula to generate a modified MSE or HMSE formula. The evaluation system can then calculate the adjusted MSE or HMSE based on the modified MSE or HMSE formula. The evaluation system determines the MSE/HMSE using the original, unmodified MSE/HMSE formula (e.g., one of the formulas represented above as Equations 1, 2, and 5).

At block 303, the evaluation system determines a quality indicator value based on the MSE/HMSE and the adjusted MSE/HMSE. The evaluation system can determine the quality indicator value with any operation which facilitates comparison of the MSE/HMSE value and the adjusted MSE/HMSE value. For example, the evaluation system may determine the quality indicator value by determining the ratio of the MSE/HMSE and the adjusted MSE/HMSE. As another example, the evaluation system may determine the quality indicator value by determining a difference of the MSE/HMSE and the adjusted MSE/HMSE or a relative or absolute error of the adjusted MSE/HMSE with respect to the MSE/HMSE. The evaluation system can normalize the quality indicator value, such as by converting the quality indicator value to a normalized value between 0 and 1, 0 and 5, etc.

At block 305, the evaluation system determines drilling quality based on the quality indicator value and a set of quality indicator rules. The quality indicator rules comprise rules which associate the quality indicator values with a quality indicator. For instance, the quality indicator rules can associate ranges of quality indicator values with a corresponding quality indicator (e.g., excellent, good, average, etc.). As an example, if the quality indicator value was normalized to a value between 0 and 10, the quality indicator rules can associate quality indicators with ranges of quality indicator values in increments of two. The quality indicators which the evaluation system has defined can then be associated with a corresponding range (e.g., a quality indicator between 0 and 2 is high quality, between 2 and 4 is good quality, etc.). The evaluation system can determine the drilling quality by evaluating the quality indicator value against the quality indicator rules to determine a quality indicator to which the quality indicator value corresponds.

At block 307, the evaluation system determines if the drilling quality indicator value has increased. The evaluation system can compare the drilling quality indicator value with a previously determined quality indicator value, an average drilling quality indicator value determined from previous drilling operations, etc. An increase in the drilling quality indicator value over time can indicate a decrease in drilling quality. For example, if the drilling quality indicator value is 6.6 which corresponds to a drilling quality indicator of "average" and the drilling quality indicator value determined at the previous time instant is 2.3 which corresponds to a drilling quality indicator of "excellent," the evaluation system can determine that the drilling quality indicator value has increased and is indicative of a decrease in drilling quality. If the drilling quality indicator value has increased, operations continue at block 309. If the drilling quality indicator has not increased, operations are complete.

At block 309, the evaluation system indicates that the drilling quality should be improved. The evaluation system can generate a notification or alarm which indicates the decrease in drilling quality (e.g., by generating a notification which indicates the current and previous drilling quality indicator values and/or drilling quality indicators). Adjustments can be made to the drilling operation to improve drilling quality based on determining that the quality has decreased over time.

Figure 4:
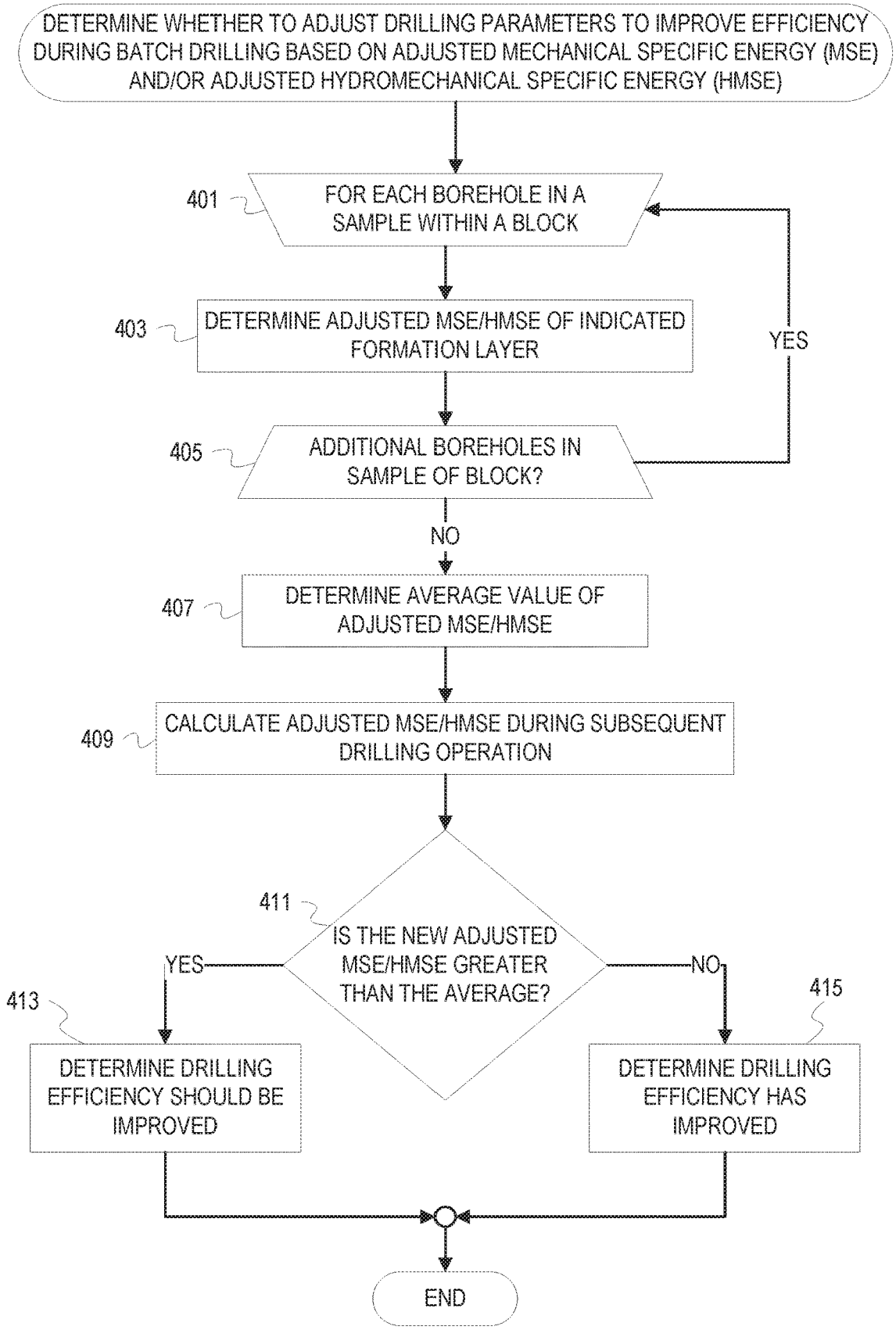
FIG. 4 depicts a flowchart of example operations for determining whether to adjust drilling parameters during batch drilling operations to improve efficiency based on the adjusted mechanical or hydromechanical specific energy, according to some embodiments.

FIG. 4 depicts a flowchart of example operations for determining whether to adjust drilling parameters during batch drilling operations to improve efficiency based on the adjusted MSE/HMSE, according to some embodiments. During batch drilling operations, an adjusted MSE/HMSE can be calculated during drilling of multiple boreholes in the same block, where the modified MSE/HMSE equation is determined as described in reference to FIGS. 1 and 2. The example operations refer to a drilling efficiency evaluation system ("efficiency evaluation system") as performing the depicted operations for consistency with FIG. 1, although naming of software and program code can vary among implementations.

At block 401, the efficiency evaluation system begins an efficiency evaluation for a sample of boreholes to be drilled in a block. Blocks may be allocated based on well type or formation type. The efficiency evaluation system can evaluate drilling efficiency for a given percentage of the total number of boreholes to be drilled in the block, for a fixed quantity of boreholes in the block (e.g., the first N boreholes drilled), etc.

At block 403, the efficiency evaluation system determines the adjusted MSE or HMSE for an indicated formation layer during drilling. A modified MSE or HMSE formula with which the adjusted MSE or HMSE can be calculated may have been previously determined as described in reference to FIGS. 1 and 2. Alternatively, a new modified MSE or HMSE formula can be determined during drilling of the current borehole of the sample as is also described in reference to FIGS. 1 and 2, where the adjusted MSE or HMSE is calculated based on the new formula. The adjusted MSE or HMSE is calculated for a particular layer of the geological formation to provide consistent evaluation of the adjusted MSE or HMSE across boreholes drilled in the block. The efficiency evaluation system may select a formation layer at which the adjusted MSE or HMSE is to be determined at the beginning of the batch drilling operation (e.g., the first formation layer), may receive from a input a selected formation layer for which the adjusted MSE or HMSE is to be determined, etc.

At block 405, the efficiency evaluation system determines if additional boreholes are to be drilled in the sample of boreholes within the block. The efficiency evaluation system can continue to determine the adjusted MSE or HMSE at the indicated formation layer for the remaining boreholes in the sample within the block.

At block 407, the efficiency evaluation system determines the average value of the adjusted MSE or HMSE calculated for the indicated formation layer of each of the boreholes in the sample of the block. The efficiency evaluation system can generate a normal distribution of the adjusted MSE or HMSE values calculated during drilling based on the mean and variance of the adjusted MSE or HMSE values. The efficiency evaluation system can also determine efficiency indicators for the batch drilling operation based on the normal distribution of adjusted MSE or HMSE values. For example, the efficiency evaluation system may associate an efficiency indicator of "highly efficient" with adjusted MSE or HMSE values in the 10th percentile, an efficiency indicator of "efficient" with adjusted MSE or HMSE values 10th to 25th percentile, etc. The efficiency evaluation system may suggest adjustments to drilling parameters (e.g., modifications to operational parameters) based on the average value of the adjusted MSE or HMSE. For example, the efficiency evaluation system may determine that the average adjusted MSE or HMSE is indicative of inefficient drilling. The efficiency evaluation system may generate a notification which includes the average adjusted MSE or HMSE and/or the weights associated with the parameters in the modified MSE or HMSE formula. Drilling parameters can be adjusted for subsequent drilling during the batch drilling operation.

At block 409, the efficiency evaluation system calculates the adjusted MSE or HMSE during a subsequent drilling operation for a borehole within the block. The efficiency evaluation system calculates the adjusted MSE or HMSE for the same formation layer for which the adjusted MSE or HMSE values in the initial subset of drilling operations were calculated. The efficiency evaluation system may determine the adjusted MSE or HMSE with the same modified MSE/HMSE formula used in the prior drilling operations or may determine a new modified MSE/HMSE formula based on new drilling data collected during the drilling operation.

At block 411, the efficiency evaluation system determines whether the adjusted MSE or HMSE calculated for the subsequent drilling operation is greater than the average adjusted MSE or HMSE calculated for the initial sample within the block. An increase in the adjusted MSE or HMSE indicates a decrease in efficiency, while a decrease in the adjusted MSE or HMSE indicates an increase in drilling efficiency. If the adjusted MSE or HMSE calculated for the subsequent drilling operation is greater than the average adjusted MSE or HMSE, operations continue at block 413. If the adjusted MSE or HMSE calculated for the subsequent drilling operation is not greater than the average adjusted MSE or HMSE, operations continue at block 415.

At block 413, the efficiency evaluation system determines that drilling efficiency should be improved. For example, the efficiency evaluation system can generate a notification which indicates that the drilling efficiency should be improved. The notification may include the average adjusted MSE or HMSE value and the new adjusted MSE or HMSE value. The drilling parameters of the drilling operation can be further refined based on determining that the efficiency should be improved as to improve efficiency during subsequent drilling operations within the batch drilling operation.

At block 415, the efficiency evaluation system determines that drilling efficiency has improved. For example, the efficiency evaluation system can generate a notification which indicates that the drilling efficiency has improved. The notification may include the average adjusted MSE or HMSE value and the new adjusted MSE or HMSE value. The current drilling parameters of the drilling operation which yielded the improved efficiency based on the adjusted MSE or HMSE calculation may be maintained.

Example Drilling Application

FIG. 5 depicts a schematic diagram of a drilling rig system, according to some embodiments. For example, in FIG. 5, it can be seen how a system 564 may also form a portion of a drilling rig 502 located at the surface 504 of a well 506. Drilling of oil and gas wells is commonly carried out using a string of drill pipes connected together so as to form a drilling string 508 that is lowered through a rotary table 510 into a wellbore or borehole 512. Here a drilling platform 586 is equipped with a derrick 588 that supports a hoist. Drilling data from the system 564 can be retrieved during a drilling operation and analyzed to determine efficiency and/or quality of the drilling operation based on an adjusted MSE/HMSE, such as with the drilling efficiency and quality evaluation system depicted in FIG. 1. The drilling efficiency and quality evaluation system as depicted in FIG. 1 may also execute in a control system 596 of the system 564.

The drilling rig 502 may thus provide support for the drill string 508. The drill string 508 may operate to penetrate the rotary table 510 for drilling the borehole 512 through subsurface formations 514. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create a borehole 512 by penetrating the surface 504 and subsurface formations 514. The down hole tool 524 may comprise any of a number of different types of tools including MWD tools, LWD tools, and others.

During drilling operations, the drill string 508 (perhaps including the Kelly 516, the drill pipe 518, and the bottom hole assembly 520) may be rotated by the rotary table 510. In addition to, or alternatively, the bottom hole assembly 520 may also be rotated by a motor (e.g., a mud motor) that is located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 514.

During drilling operations, a mud pump 532 may pump drilling fluid (sometimes known by those of ordinary skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 512. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation 514 cuttings created by operating the drill bit 526.

Figure 6:
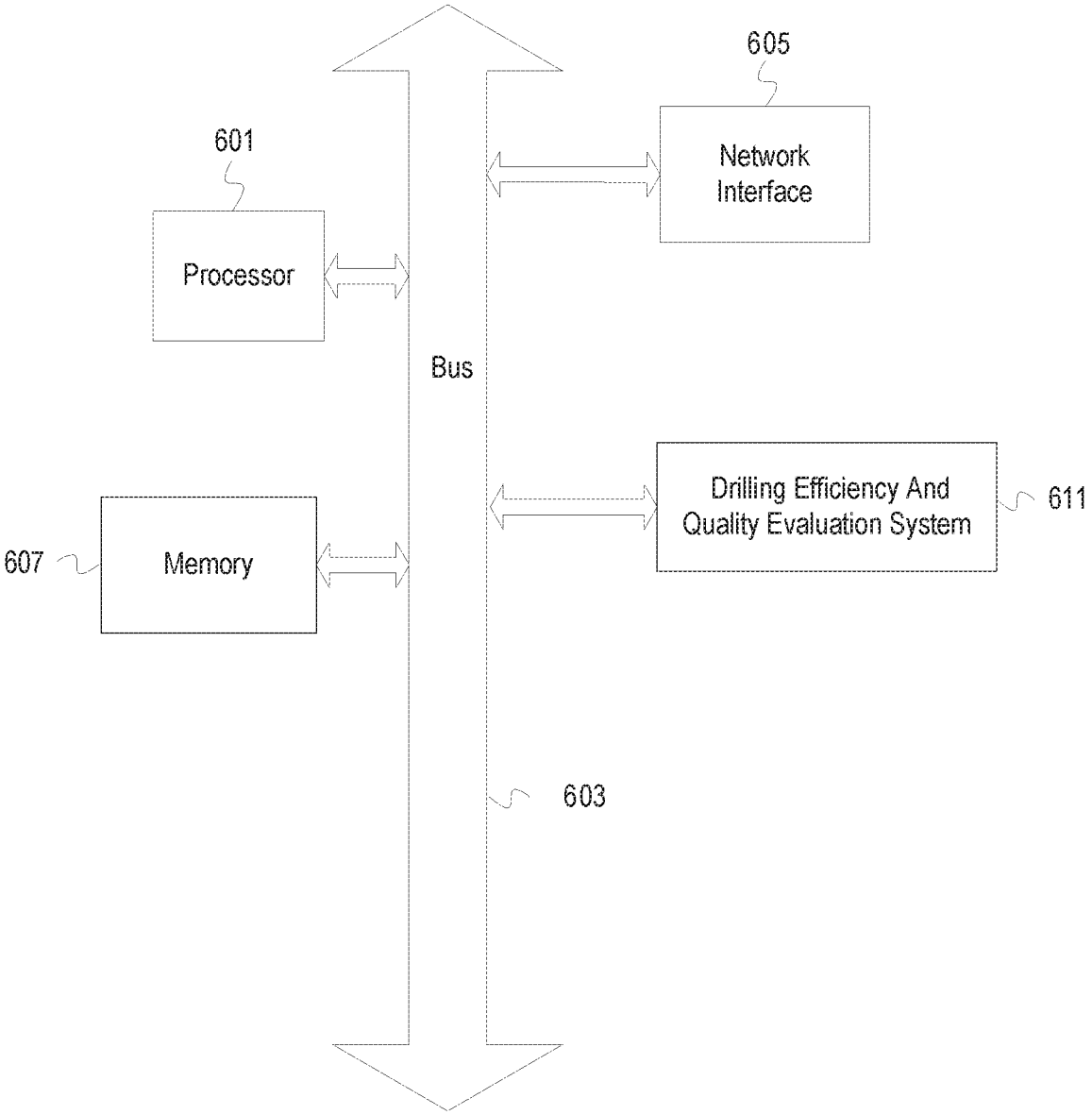
FIG. 6 depicts an example computer, according to some embodiments.

FIG. 6 depicts an example computer, according to some embodiments. The computer system includes a processor 601 (possibly including multiple processors, multiple cores, multiple nodes, and/or implementing multi-threading, etc.). The computer system includes memory 607. The memory 607 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 603 (e.g., PCI, ISA, PCI-Express, HyperTransport® bus, InfiniBand® bus, NuBus, etc.) and a network interface 605 (e.g., a Fiber Channel interface, an Ethernet interface, an internet small computer system interface, SONET interface, wireless interface, etc.). The system also includes a drilling efficiency and quality evaluation system 611. The drilling efficiency and quality evaluation system 611 determines a modified MSE or HMSE formula based on data collected during a drilling operation and evaluates the efficiency and quality of the drilling operation based on an adjusted MSE or HMSE calculated with the modified MSE or HMSE formula. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

Variations

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 201 and 203 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for determining an adjusted mechanical or hydromechanical specific energy and evaluating efficiency and quality of a drilling operation based on the adjusted mechanical or hydromechanical specific energy as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A method comprising: drilling a borehole; capturing data during drilling of the borehole, wherein the data comprises at least one value of at least one operational parameter of the drilling; modifying a specific energy formula used to determine at least one of an efficiency and a quality of drilling of a borehole, wherein the modifying of the specific energy formula is based on data captured during drilling of the borehole, wherein the specific energy formula comprises at least one of a mechanical specific energy (MSE) formula and a hydromechanical specific energy (HMSE) formula; calculating an adjusted specific energy value for the drilling based on the modified specific energy formula; and determining at least one of the efficiency and the quality of the drilling of the borehole based on the adjusted specific energy value.

Embodiment 2: The method of Embodiment 1, further comprising modifying the drilling of the borehole based on at least one of the efficiency and the quality.

Embodiment 3: The method of Embodiments 1 or 2, wherein modifying the specific energy formula comprises weighting at least one parameter of the specific energy formula based on the data captured during drilling of the borehole.

Embodiment 4: The method of Embodiment 3, wherein weighting the at least one parameter comprises weighting the at least one parameter using unsupervised learning with a neural network, wherein the data captured during the drilling is input to the neural network.

Embodiment 5: The method of Embodiment 3, wherein weighting the at least one parameter comprises assigning a weight to the at least one parameter, wherein the weight comprises comprise at least one of a coefficient and an exponent.

Embodiment 6: The method of any one of Embodiments 1-5, wherein modifying the specific energy formula comprises removing an outlier of the at least one value of the at least one operational parameter.

Embodiment 7: The method of any one of Embodiments 1-6 further comprising calculating an actual specific energy value for the drilling based on the specific energy formula prior to modification, wherein determining the quality of the drilling of the borehole comprises comparing the adjusted specific energy value with the actual specific energy value.

Embodiment 8: The method of Embodiment 7, wherein comparing the adjusted specific energy value with the actual specific energy value comprises determining at least one of a ratio of the adjusted specific energy value and the actual specific energy value, a difference of the adjusted specific energy value and the actual specific energy value, and an error of the adjusted specific energy value relative to the actual specific energy value.

Embodiment 9: The method of any one of Embodiments 1-8, wherein determining the efficiency of the drilling of the borehole comprises: determining adjusted specific energy values for drilling of a first formation layer for a first subset of drilling operations of the drilling; averaging the adjusted specific energy values for drilling of the first formation layer for the first subset of drilling operations based on the adjustment to create an average adjusted specific energy value; determining an adjusted specific energy value for drilling the first formation layer for a second subset of drilling operations; and determining the efficiency of the drilling has increased based on comparing the average adjusted specific energy value for the first subset of drilling operations to the adjusted specific energy value for the second subset of drilling operations.

Embodiment 10: The method of claim any one of Embodiments 1-9, wherein determining at least one of the efficiency and the quality of the drilling of the borehole comprises calculating an uncertainty of at least one of the efficiency and the quality based on distributions of the data captured during the drilling.

Embodiment 11: A system comprising: a drill string comprising, a drill bit to drill a borehole; and a bottom hole assembly having at least one sensor to capture data during drilling of the borehole, wherein the data comprises at least one value of at least one operational parameter of the drilling; a processor; and a machine-readable medium having program code executable by the processor to cause the processor to, modify a specific energy formula used to determine at least one of an efficiency and a quality of drilling of the borehole, wherein modification of the specific energy formula is based on data captured during drilling of the borehole, wherein the specific energy formula comprises at least one of a mechanical specific energy (MSE) formula and a hydromechanical specific energy (HMSE) formula; calculate an adjusted specific energy value for the drilling based on the modified specific energy formula; and determine at least one of the efficiency and the quality of the drilling of the borehole based on the adjusted specific energy value.

Embodiment 12: The system of Embodiment 11, wherein drilling of the borehole is modified based on at least one of the efficiency and the quality.

Embodiment 13: The system of Embodiments 11 or 12, wherein the program code executable by the processor to cause the processor to modify the specific energy formula comprises program code executable by the processor to cause the processor to weight at least one parameter of the specific energy formula based on the data captured during drilling of the borehole.

Embodiment 14: The system of Embodiment 13, wherein the program code executable by the processor to cause the processor to weight the at least one parameter comprises program code executable by the processor to cause the processor to assign a weight to the at least one parameter, wherein the weight comprises comprise at least one of a coefficient and an exponent.

Embodiment 15: The system of any one of Embodiments 11-14, wherein the program code executable by the processor to cause the processor to modify the specific energy formula comprises program code executable by the processor to cause the processor to remove an outlier of the at least one value of the at least one operational parameter.

Embodiment 16: The system of any one of Embodiments 11-15, wherein the program code executable by the processor to cause the processor to determine at least one of the efficiency and the quality of the drilling of the borehole comprises program code executable by the processor to cause the processor to calculate an uncertainty of at least one of the efficiency and the quality based on distributions of the data captured during the drilling.

Embodiment 17: One or more non-transitory machine-readable media comprising program code executable by a processor to cause the processor to: capture data during drilling of a borehole, wherein the data comprises at least one value of at least one operational parameter of the drilling; modify a specific energy formula used to determine at least one of an efficiency and a quality of drilling of a borehole, wherein the modification of the specific energy formula is based on data captured during drilling of the borehole, wherein the specific energy formula comprises at least one of a mechanical specific energy (MSE) formula and a hydromechanical specific energy (HMSE) formula; calculate an adjusted specific energy value for the drilling based on the modified specific energy formula; and determine at least one of the efficiency and the quality of the drilling of the borehole based on the adjusted specific energy value.

Embodiment 18: The one or more non-transitory machine-readable media of Embodiment 17, wherein the program code executable by a processor to cause the processor to modify the specific energy formula comprises program code executable by a processor to cause the processor to weight at least one parameter of the specific energy formula based on the data captured during drilling of the borehole.

Embodiment 19: The one or more non-transitory machine-readable media of Embodiment 18, wherein the program code executable by a processor to cause the processor to weight the at least one parameter comprises program code executable by a processor to cause the processor to assign a weight to the at least one parameter, wherein the weight comprises comprise at least one of a coefficient and an exponent.

Embodiment 20: The one or more non-transitory machine-readable media of any one of Embodiments 17-19, wherein the program code executable by a processor to cause the processor to modify the specific energy formula comprises program code executable by a processor to cause the processor to remove an outlier of the at least one value of the at least one operational parameter.

What is claimed is:

1. A method comprising:

drilling a borehole;

capturing data during the drilling of the borehole, wherein the data comprises at least one value of at least one operational parameter of the drilling;

modifying a specific energy formula used to determine at least one of an efficiency and a quality of the drilling of the borehole, wherein the modifying of the specific energy formula is based on the data captured during the drilling of the borehole, wherein the specific energy formula comprises at least one of a mechanical specific energy (MSE) formula and a hydromechanical specific energy (HMSE) formula;

calculating an adjusted specific energy value for the drilling based on the modified specific energy formula;

determining at least one of the efficiency and the quality of the drilling of the borehole based on the adjusted specific energy value; and modifying the drilling of the borehole based on the at least one of the efficiency and the quality.

2. The method of claim 1, wherein modifying the specific energy formula comprises weighting at least one parameter of the specific energy formula based on the data captured during the drilling of the borehole.

3. The method of claim 2, wherein weighting the at least one parameter comprises weighting the at least one parameter using unsupervised learning with a neural network, wherein the data captured during the drilling is input to the neural network.

4. The method of claim 2, wherein weighting the at least one parameter comprises assigning a weight to the at least one parameter, wherein the weight comprises at least one of a coefficient and an exponent.

5. The method of claim 1, wherein modifying the specific energy formula comprises removing an outlier of the at least one value of the at least one operational parameter.

6. The method of claim 1 further comprising calculating an actual specific energy value for the drilling based on the specific energy formula prior to modification, wherein determining the quality of the drilling of the borehole comprises comparing the adjusted specific energy value with the actual specific energy value.

7. The method of claim 6, wherein comparing the adjusted specific energy value with the actual specific energy value comprises determining at least one of a ratio of the adjusted specific energy value and the actual specific energy value, a difference of the adjusted specific energy value and the actual specific energy value, and an error of the adjusted specific energy value relative to the actual specific energy value.

8. The method of claim 1, wherein determining the efficiency of the drilling of the borehole comprises:

determining adjusted specific energy values for drilling of a first formation layer for a first subset of drilling operations of the drilling;

averaging the adjusted specific energy values for the drilling of the first formation layer for the first subset of drilling operations to create an average adjusted specific energy value;

determining the adjusted specific energy value for the drilling the first formation layer for a second subset of drilling operations; and determining the efficiency of the drilling has increased based on comparing the average adjusted specific energy value for the first subset of drilling operations to the adjusted specific energy value for the second subset of drilling operations.

9. The method of claim 1, wherein determining at least one of the efficiency and the quality of the drilling of the borehole comprises calculating an uncertainty of at least one of the efficiency and the quality based on distributions of the data captured during the drilling.

10. A system comprising:

a drill string comprising, a drill bit to drill a borehole; and a bottom hole assembly having at least one sensor to capture data during drilling of the borehole, wherein the data comprises at least one value of at least one operational parameter of the drilling;

a processor; and a machine-readable medium having program code executable by the processor to cause the processor to, modify a specific energy formula used to determine at least one of an efficiency and a quality of the drilling of the borehole, wherein modification of the specific energy formula is based on the data captured during the drilling of the borehole, wherein the specific energy formula comprises at least one of a mechanical specific energy (MSE) formula and a hydromechanical specific energy (HMSE) formula;

calculate an adjusted specific energy value for the drilling based on the modified specific energy formula; and determine at least one of the efficiency and the quality of the drilling of the borehole based on the adjusted specific energy value, wherein the drilling of the borehole is modified based on the at least one of the efficiency and the quality.

11. The system of claim 10, wherein the program code executable by the processor to cause the processor to modify the specific energy formula comprises program code executable by the processor to cause the processor to weight at least one parameter of the specific energy formula based on the data captured during the drilling of the borehole.

12. The system of claim 11, wherein the program code executable by the processor to cause the processor to weight the at least one parameter comprises program code executable by the processor to cause the processor to assign a weight to the at least one parameter, wherein the weight comprises at least one of a coefficient and an exponent.

13. The system of claim 10, wherein the program code executable by the processor to cause the processor to modify the specific energy formula comprises program code executable by the processor to cause the processor to remove an outlier of the at least one value of the at least one operational parameter.

14. The system of claim 10, wherein the program code executable by the processor to cause the processor to determine at least one of the efficiency and the quality of the drilling of the borehole comprises program code executable by the processor to cause the processor to calculate an uncertainty of at least one of the efficiency and the quality based on distributions of the data captured during the drilling.

15. One or more non-transitory machine-readable media comprising program code executable by a processor to cause the processor to:

capture data during drilling of a borehole, wherein the data comprises at least one value of at least one operational parameter of the drilling;

modify a specific energy formula used to determine at least one of an efficiency and a quality of the drilling of the borehole, wherein modification of the specific energy formula is based on the data captured during the drilling of the borehole, wherein the specific energy formula comprises at least one of a mechanical specific energy (MSE) formula and a hydromechanical specific energy (HMSE) formula;

calculate an adjusted specific energy value for the drilling based on the modified specific energy formula; and determine at least one of the efficiency and the quality of the drilling of the borehole based on the adjusted specific energy value, wherein the drilling of the borehole is modified based on the at least one of the efficiency and the quality.

16. The one or more non-transitory machine-readable media of claim 15, wherein the program code executable by the processor to cause the processor to modify the specific energy formula comprises program code executable by the processor to cause the processor to weight at least one parameter of the specific energy formula based on the data captured during the drilling of the borehole.

17. The one or more non-transitory machine-readable media of claim 16, wherein the program code executable by the processor to cause the processor to weight the at least one parameter comprises program code executable by the processor to cause the processor to assign a weight to the at least one parameter, wherein the weight comprises at least one of a coefficient and an exponent.

18. The one or more non-transitory machine-readable media of claim 15, wherein the program code executable by the processor to cause the processor to modify the specific energy formula comprises program code executable by the processor to cause the processor to remove an outlier of the at least one value of the at least one operational parameter.

* * * * *